US005813828A

United States Patent [19]

Norris

[11] Patent Number: 5,813,828

[45] Date of Patent: Sep. 29, 1998

[54] METHOD AND APPARATUS FOR ENHANCING GAS TURBO MACHINERY FLOW

[76] Inventor: Thomas R. Norris, 15 Patricia Rd., Orinda, Calif. 94563

[21] Appl. No.: 820,220

[22] Filed: Mar. 18, 1997

[51] Int. Cl.[6] ..... F01D 9/04; F01D 9/06

[52] U.S. Cl. ..... 415/115; 415/142; 415/914

[58] Field of Search ..... 415/115, 116, 415/142, 208.1, 208.2, 210.1, 211.2, 914

[56] References Cited

U.S. PATENT DOCUMENTS

| | | | |
|---|---|---|---|
| 3,405,865 | 10/1968 | Lagelbauer | 415/116 |
| 3,572,960 | 3/1971 | McBride | 415/115 |
| 4,712,980 | 12/1987 | Gely et al. | 415/914 |
| 5,161,947 | 11/1992 | Eckfeldt et al. | 415/142 |
| 5,340,276 | 8/1994 | Norris et al. | 415/208.1 |

FOREIGN PATENT DOCUMENTS

| | | | |
|---|---|---|---|
| 61-118504 | 6/1986 | Japan | 415/115 |
| 1454861 | 11/1976 | United Kingdom | 415/208.1 |

*Primary Examiner*—Christopher Verdier

*Attorney, Agent, or Firm*—Townsend and Townsend and Crew

[57] ABSTRACT

In a conduit constituting the outlet from turbo machinery such as a turbine or compressor, stall gas having high static pressure and low velocity is collected. This stall gas is then routed through struts—preferably teardrop shaped—to more central low static pressure and high velocity gas flow areas. At these areas, the gas is discharged, preferably through multiple manifold openings. Mixing of the collected high static pressure, low velocity stall gas with the low static pressure, high velocity main stream gas occurs. Turbine noise, vibration, and back pressure are decreased with resulting improvements of efficiency. Variations are illustrated including adaptation of gas flow transfer utilizing turning vanes, fairings, rectangular duct turns, and struts for placement in turbine turbo machine outlets having high turbulence or variable swirl.

10 Claims, 8 Drawing Sheets

METHOD AND APPARATUS FOR ENHANCING GAS TURBO MACHINERY FLOW

This invention relates to providing improved flow efficiencies at the discharge of gas turbo machinery. Gas flowing at low velocity, but with significant static pressure is collected at or near the walls of ducting—usually diffusers—and routed through struts. The struts, typically used for structural reinforcement of the flow ducts, are preferably manifolded and discharge to high velocity, low static pressure, locations in the main flow stream. The resultant intermixing enables gas exhaust flow of higher efficiency through a diffuser, or other duct where pressure increases in the direction of flow.

BACKGROUND OF THE INVENTION

In Norris et al. U.S. Pat. No. 5,340,276, issued Aug. 23, 1994, entitled METHOD AND APPARATUS FOR ENHANCING GAS TURBO MACHINERY FLOW, we called attention to the phenomena of stall gas in a diffuser and the mechanism by which this stall gas produces inefficient flow. Specifically, gas from a turbo machine flows from low to high pressure in a conduit—such as an expanding diffuser between blading of the turbo-machine. The case of a conventional diffuser has been described, but it is understood that the methods apply to areas between blading as well, where the pressure increases in the direction of flow. Gas adjacent the walls of the diffuser moves at approximate ½ to ¼ the speed of gas away from the walls of the diffuser. At the same time, this slow moving gas has a relatively high static pressure. As a consequence, this gas frequently stalls adjacent the walls of the diffuser, and thereafter "falls" backward into the low static pressure areas upstream. There results inefficiencies due to turbulence and resulting noise (such as rumbling), vibration, and high turbine back pressure. Overall turbo machinery loss of efficiency results. Further, rapid deterioration of the diffuser and other gas conduits connected to the turbo machine can occur due to the vibration.

In Norris et al., the proposed solution was the routing of the stall gas in split ducting from the main gas flow stream. Specifically, a barrier wall along the side of the diffuser was utilized to guide and isolate the stall gas flow. Thus the separated flow conduit included the very wall of the diffuser which caused the slow gas flow initially. In Norris et al., a surface projecting into the flow from a turbine discharge wall defined a split conduit, routing the low velocity, high static pressure gas along the diffuser wall was used. This defined a separate conduit originating in one portion of the diffuser and discharging to another portion of the diffuser at a location of recombining where mixing could occur. The site of the discharge of the split passages was such that the stall gas under went sufficient mixing and was removed with the main gas discharge from the diffuser. This transport, intermixing and removal occurred in all cases in an area bounded by the wall of the conduit; no provision was made for routing the gas elsewhere, as within a strut-like passage.

In the following specification, "stall gas" refers to gas that has slowed down and stopped, reversed, or threatens to do either, so as to result in turbulence and inefficiency.

In the following specification, "teardrop" shaped refers to a streamlined airfoil shape having a generally rounded leading edge and relatively sharp trailing edge, and may be non-synmetric about a chord, and may produce lift.

SUMMARY OF THE INVENTION

In a strut reinforced conduit constituting the outlet from turbo machinery blading such as a turbine or compressor diffuser, stall gas having high static pressure and low velocity is collected. This stall gas is then routed through struts—preferably teardrop shaped struts—to more central low static pressure and high velocity gas flow areas. At these areas, the gas is discharged, preferably through multiple manifold openings. Mixing of the collected high static pressure, low velocity stall gas with the low static pressure, high velocity main stream gas occurs. Turbine noise, vibration, and back pressure are decreased with resulting improvements of efficiency. Variations are illustrated including adaptation of gas flow transfer utilizing turning vanes, so-called collector boxes, rectangular duct turns, and struts for placement in turbine exhausts having high turbulence or highly variable swirls.

BRIEF DESCRIPTION OF THE DRAWINGS

FIGS. 6A, 6B, 6C, and 6D illustrate various strut configurations in which FIG. 6A is a teardrop shaped strut with the trailing end of the strut manifolded, FIG. 6B is a teardrop shaped strut with the trailing edge of the strut provided with a longitudinally extending slit; FIG. 6C is a circular strut for use with turbo machines having gas discharged with varying attack angles on the strut due to high turbulence or variable swirl; and FIG. 6D is truncated strut having a manifolded discharge into the passing and surrounding gas stream; and, FIG. 7 is a schematic illustrating the cascading of struts of this invention along an elongate diffuser.

DESCRIPTION OF THE PREFERRED EMBODIMENT

Figure 1:
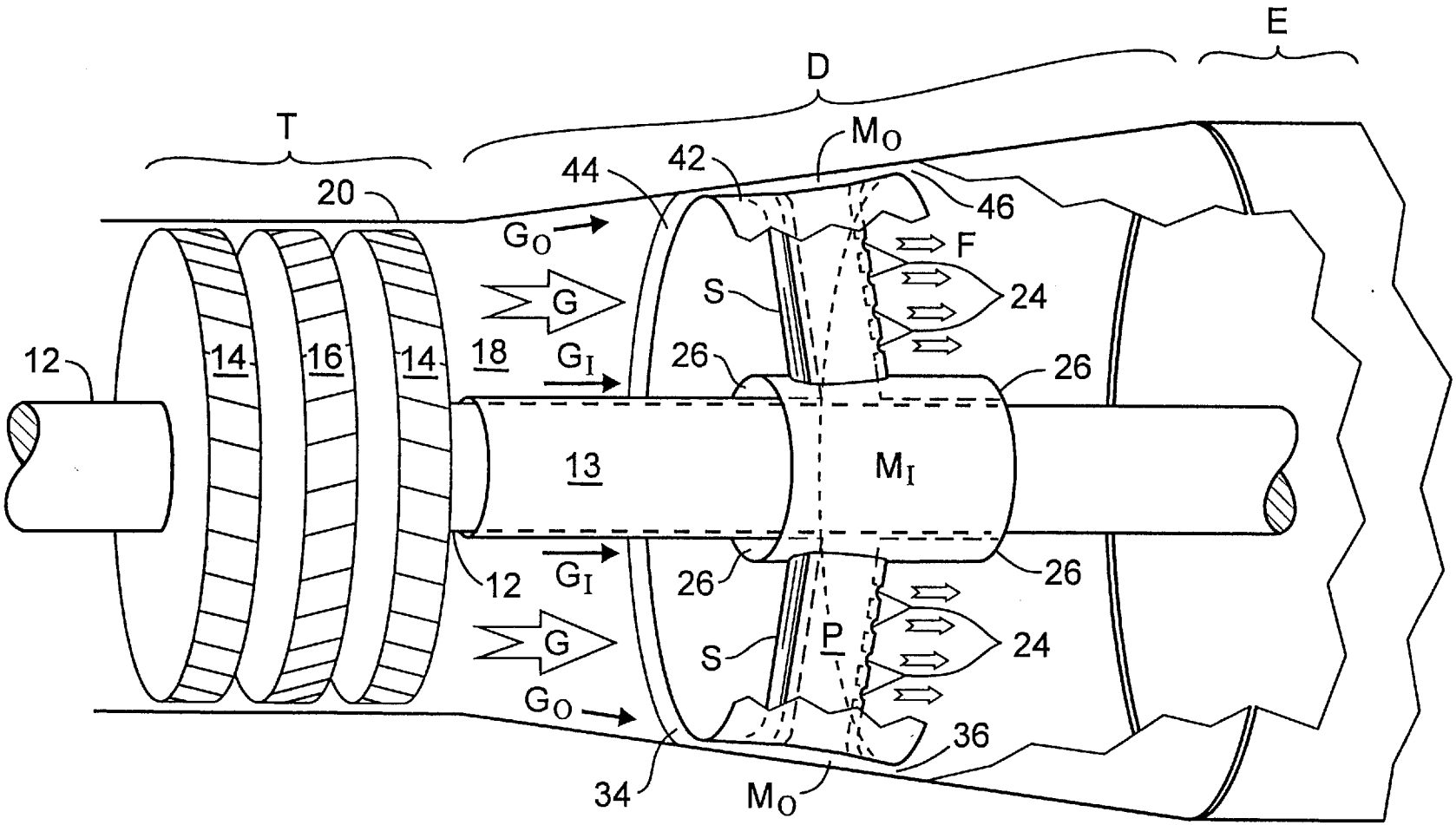
FIG. 1 is a side elevation in partial perspective of a turbo machine having turbo machine blading discharging an outlet diffuser with the teardrop shaped strut fastened to a wall of the exhaust diffuser, the diffuser here having exemplary upstream and downstream collection ducts adjacent both peripheral walls and interior shaft housing walls.

Referring to FIG. 1, turbo machine T has shaft 12 interior of machine casing 20. Turbo machine T is shown having shaft attached blading 14, turbo machine casing attached blading 16 ending in outlet 18. As is common, outlet 18 has diffuser D attached. The conventional purpose of diffuser D is to promote flow efficiency of main flow gases G in their exit from turbo machine T. Specifically, with an efficient outflow through diffuser D, pressure is lowered on turbo machine T at outlet 18. With a lower pressure at outlet 18, turbo machine T can realize greater efficiency.

Before proceeding further, it is well to set forth the problem to be solved. Specifically, main flow gases G have low static pressure and high velocity at outlet 18. It is noted that these gases are central of the annulus created around shaft 12, or shaft housing 13 on the inside and diffuser D on the outside.

Unfortunately, outside boundary gases $G_O$ and inside boundary gases $G_I$ do not share the velocity of main flow gases G. This is due in large measure to the friction generated at the boundary between the walls forming the sides of the annular flow path and the passing gas. Typically, inside boundary gases $G_I$ and outside boundary gases $G_O$ have a velocity of about one half to one forth of main flow gases G. Further, these inside boundary gases $G_I$ and outside boundary gases $G_O$ have a static pressure exceeding that in main flow gases G a short distance upstream. If left unabated, these outside boundary gases $G_O$ and inside boundary gases $G_I$ will slow, stop, or even reverse, drawn toward the upstream interior of the diffuser D. Simply stated, and because of their respective low velocities, the stall gases have insufficient energy to reach exit E of diffuser D.

Commonly, the stall gas accumulation problem is corrected by reducing the divergence angle of the diffusing passage, usually by lengthening the passage, or by subdividing into separate passages of lesser angle of divergence. Also, stall gas can be collected and pumped out by an external blower or, for a pressurized system, simply released to the atmosphere. In general, these solutions are bulky, require extra mechanical equipment, and do not distribute the stall gas within the main flow. Only the subdivided diffusers are usually seen in practice, but then, their large size, weight, and cost limits their effectiveness.

It is conventional to reinforce such diffuser D with struts S. In the case here shown, shaft 12 passes through shaft housing 13 and stall gas collector $M_I$ centrally of struts S. Struts S thus become a centering structural member, firmly anchoring shaft housing 13 with respect to diffuser D. In what follows, I use the presence of these struts S to abate that turbulence which might otherwise be caused by inside boundary gases $G_I$ and outside boundary gases $G_O$.

First, struts S are each hollow being provided with interior strut passage P. Second, adjacent to each base of each strut S adjoining the inside and outside walls of diffuser D there are provided stall gas collection manifolds $M_I$ and $M_O$. As will hereafter be seen, stall gas collection manifolds $M_I$ and $M_O$ collect stall gas respectively from either inside boundary gases $G_I$ or outside boundary gases $G_O$, and route the collected stall gas to interior strut passage P of struts S.

Struts S are provided with openings for gas outflow F. Preferably, gas outflow F is issued from discrete manifold apertures 24. It has been found that discrete manifold apertures 24 enable preferred mixing of the routed stall gas into main flow gases G. As will hereafter be made clear, slits may be used as well.

Regarding such mixing, stall gas passes from interior strut passage P out through gas outflow F at manifold apertures 24 and enters the flow of main flow gases G. Upon such entry, at some distance downstream from struts S, mixing of gas occurs and becomes substantially complete.

The reader will note that generally two effects occur. First, stall gas is removed from the walls of diffuser D. Second, when the stall gas intermixes with the main flow gases G, overall energy of main flow gases G is decreased. However, since these gases have more than abundant energy to reach exit E of diffuser D, the overall transfer is beneficial. Specifically, less noise results, there is less vibration within diffuser D, and finally shaft attached blading 14 and turbo machine casing attached blading 16 see a lower back pressure allowing turbo machine T to have a higher efficiency.

Having set forth the general theory of operation, the embodiments of FIG. 1 of stall gas collection manifolds $M_I$ and $M_O$ can be set forth. First, and regarding inside boundary gases $G_I$, it will be seen that they enter stall gas collection manifold $M_I$ either upstream collector 26 or downstream collector 28. Second, and regarding outside boundary gases $G_O$, they have different stall gas collection manifolds $M_O$, each with upstream and downstream collection ports. It will be understood that I prefer to have either upstream collector 26 or downstream collector 28, but not both because flow may enter the downstream collector and exit the upstream collector, where pressure is lower. FIG. 1 shows a variety of such stall gas collection manifolds and collectors in the interests of illustration; in actual practice these particular varieties of collection manifolds M would not be used together. One type of collector would be selected and used with consistency in the same part of a stall gas abatement design.

Referring to FIG. 2, peripheral collection manifold 32 is illustrated. Generally this peripheral collection manifold 32 would collect gases either at upstream collector 34 or downstream collector 36. It will be noted that downstream collector 36 has the advantage of requiring stall gas flow turn of over 90° or even reversal from the general flow direction of outside boundary gases $G_O$; this collection has the advantage of only collecting those gases which are most likely to create the true stall condition. All other gases can be swept away and eventually intermixed with the gas flow.

Figure 7:
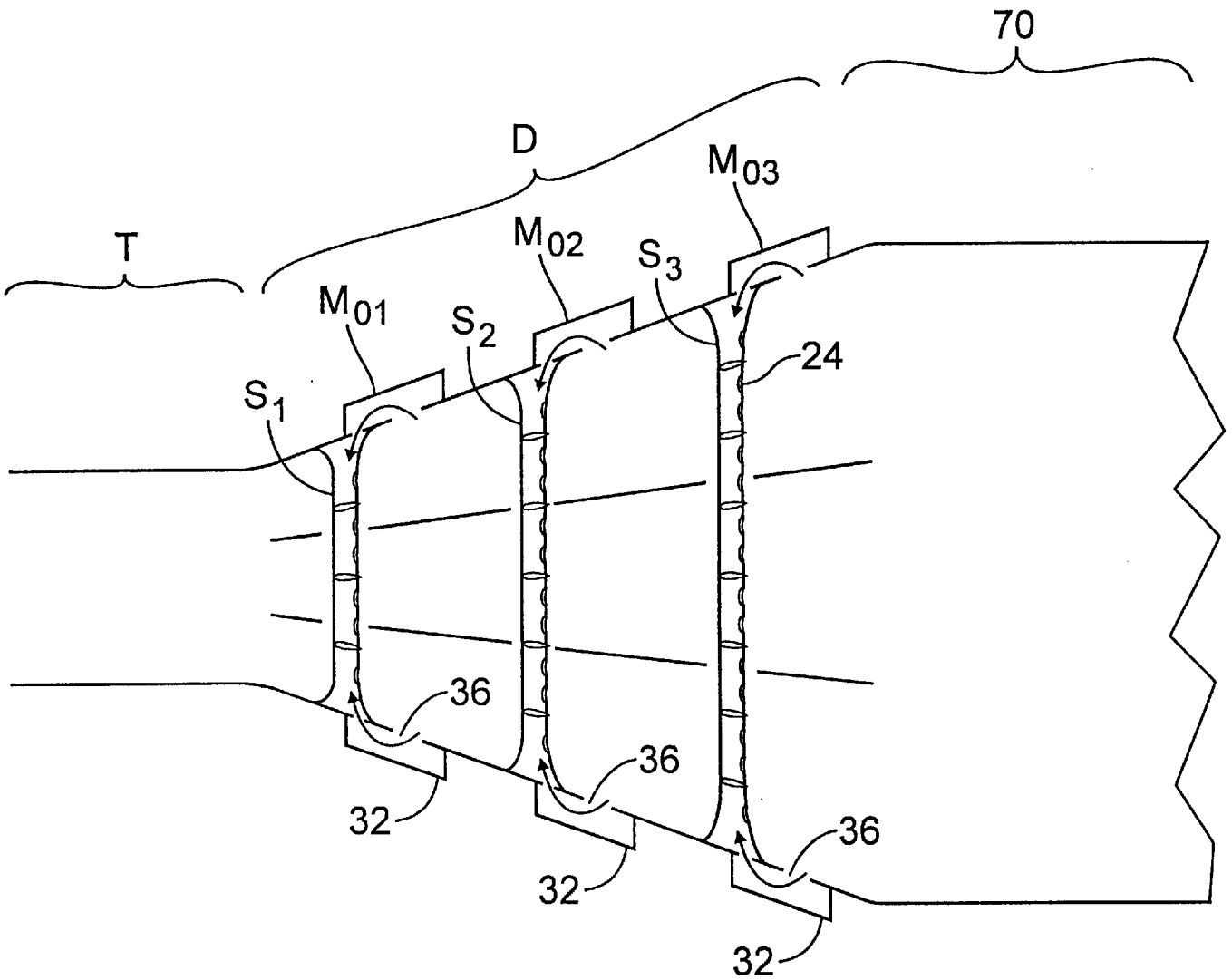

FIG. 7 shows a simpler arrangement with the peripheral collection manifold 32. The collector 36 is simply openings in the diffuser cone, which simplifies construction.

The reader should understand that the collection of stall gas should preferably be kept to a minimum; that is the collection should be only sufficient to do the job. It is therefore preferable for the stall gas collectors to have inlet gaps not exceeding 7% of the flow space width, or up to 20% if directly behind a vane or obstruction.

At the upper portion of FIG. 1, strut base collection manifold 42 is illustrated. This could have upstream strut base collector 44 or downstream strut base collector 46. The reader will again understand that I prefer downstream strut base collector 46 for the reason that gas flow turn or reversal from outside boundary gases $G_O$ is required, and because the static pressure is higher, insuring a strong flow. The upstream collector location has the potential of reverse flow.

FIG. 1 illustrates turbo machine T with shaft 12 passing through and centrally of diffuser D. This being the case, it should be understood that the outside of the shaft or shaft housing is an additional place that stall gas can accumulate. Consequently, inside boundary gases $G_I$ are collected and routed to struts S.

Figure 2A:
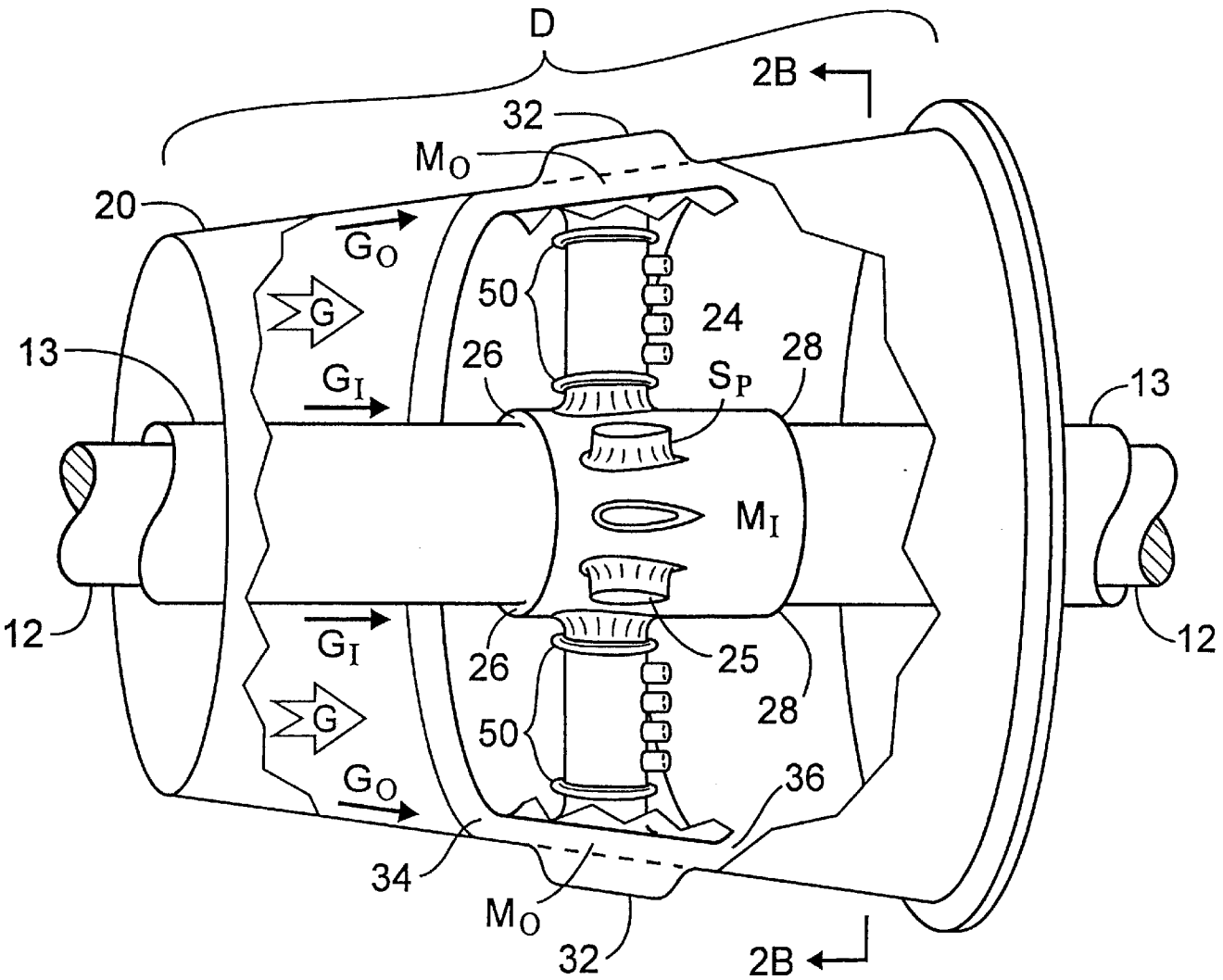
FIG. 2A is side elevation in partial perspective illustrating teardrop shaped struts with both full and partial lengths with the full length struts exhibiting so-called stall fences to prevent propagation of stall gases along their respective lengths.

Referring to FIG. 2A, I illustrate stall gas abatement designs illustrating two important features. I have found that where struts S extend entirely across the annular flow path defined between shaft housing 13 and diffuser D, stall gas accumulations can propagate over the surface of struts S. When this propagation occurs unabated, struts S can participate in generating inefficient flow. Two changes in the design are shown which can prevent this propagation.

First, stall fences 50 can be utilized. These fences prevent or inhibit the propagation of inside boundary gases $G_I$ or outside boundary gases $G_O$ transverse to main flow gases G.

Second, and where structural reinforcement of diffuser D is not required, partial length struts $S_P$ can be used. As these partial length struts $S_P$ do not extend entirely across the flow path, but generally terminate within main flow gases G, they will cause favorable stall gas distribution.

Regarding partial length struts $S_P$, these struts may be utilized with or without interior strut passages P and dependent upon the particular design may be present with or without slits or apertures for the discharge of gas. However, only those struts with interior passages P are novel.

Figure 2B:
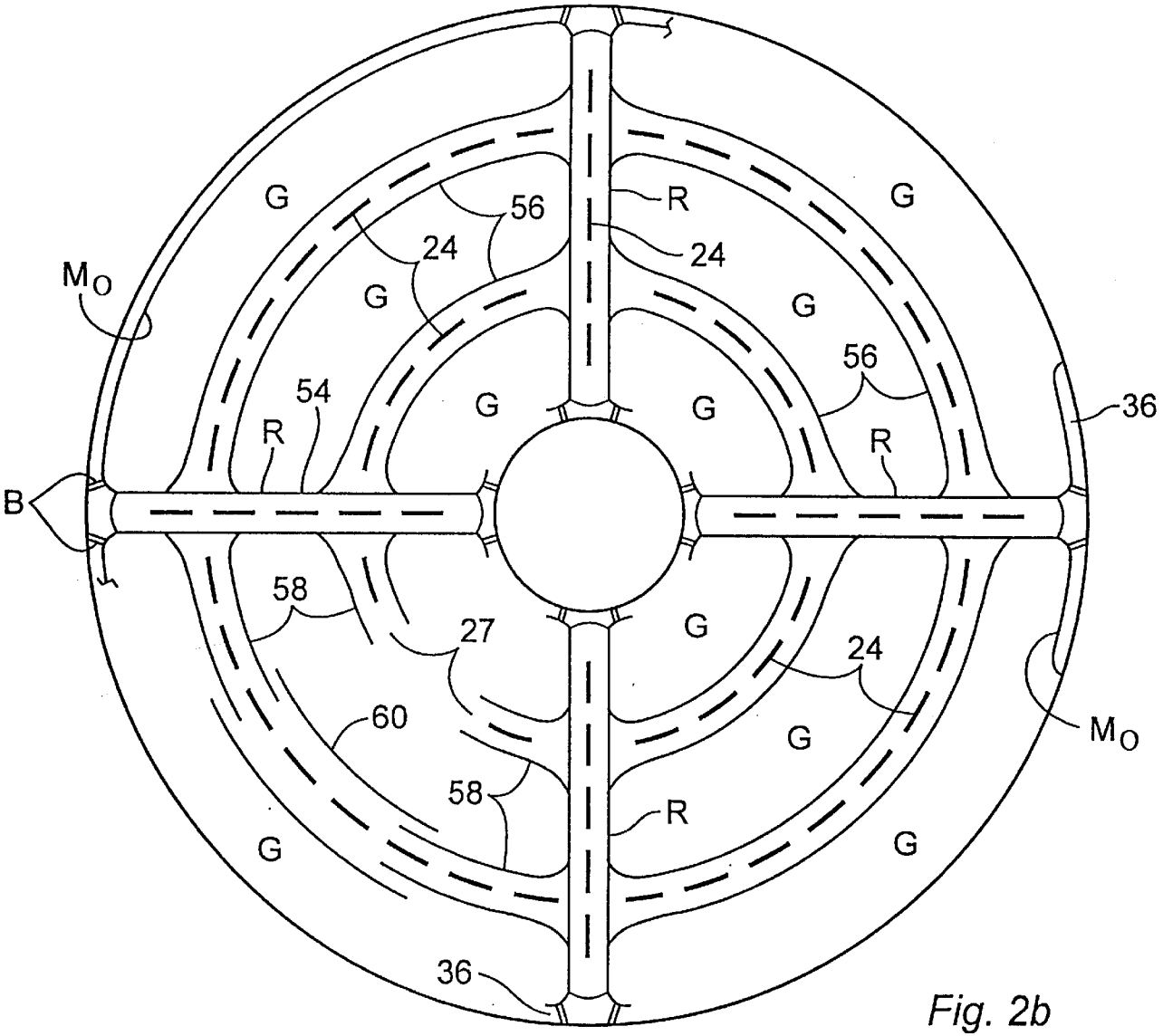
FIG. 2B is a section taken along lines 2B—2B of FIG. 2A illustrating both teardrop shaped struts and vanes disposed in the flow gases for effecting redistribution of stall gases from the wall to the main stream flow areas.

Referring to FIG. 2B, I illustrate in section taken normal to and looking downstream to the flow of main flow gases G radial vane array R. Such radial vane arrays R are commonly found; but do not include the stall gas routing of this invention. Specifically, four radial vanes 54 are shown supporting circumferential vanes. As before, I illustrate several types of circumferential vanes; generally in a singular design only one type of circumferential vane is utilized.

First, I illustrate continuous circumferential vanes 56 with discreate manifold apertures 24. While such continuous vanes are beneficial for flow distribution, with expansion and contraction due to heating and cooling of the exhaust, such continuous circumferential vanes 56 have been know to fail.

For that reason, I can utilize partial circumferential vanes 58 with an outlet aperture 27. These vanes do not entirely extend around and therefore do not entirely guide the flow.

Finally, and as a preferred alternative, I show sleeve 60 over partial circumferential vanes 58. This has the advantage of permitting thermal flexibility while maintaining the guiding of flow entirely around shaft 12 and shaft housing 13.

It will be understood that turning of gas exhausted from a turbo machine is frequently required. Accordingly, and with respect to FIGS. 3A and 3B, I illustrate such a turn, the actual turbo machine being omitted from the figure.

Figure 3A:
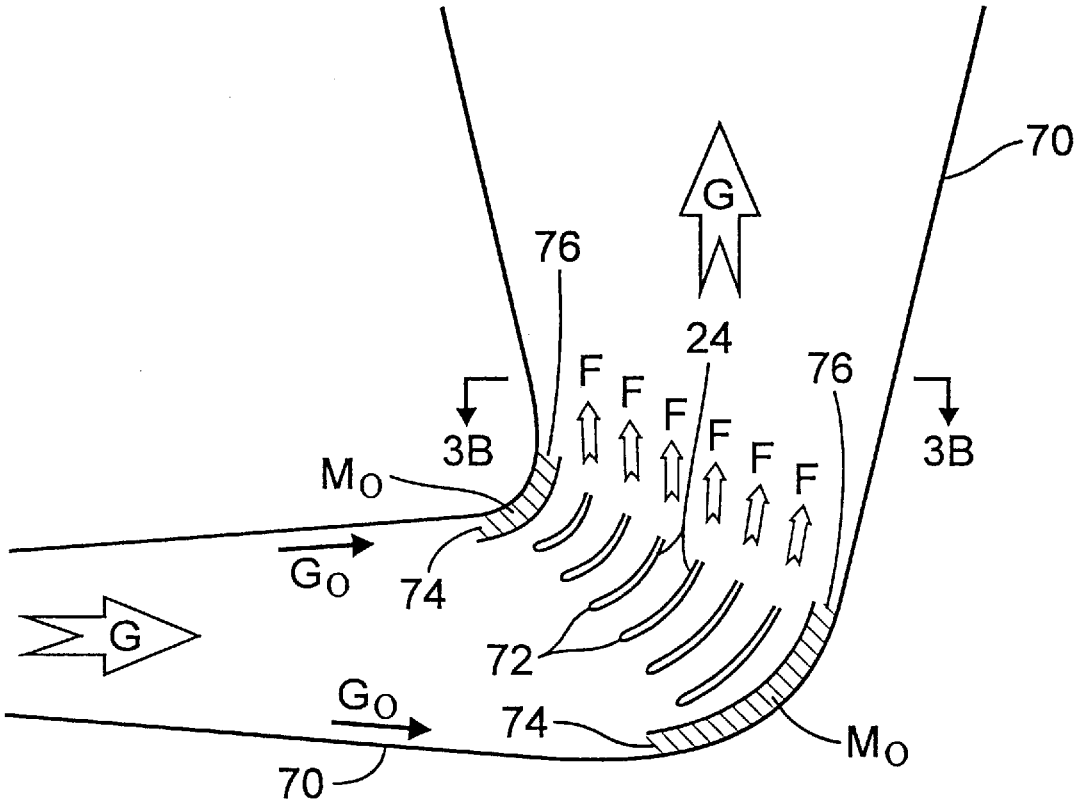
FIG. 3A is a side elevation section of a turning diffuser illustrating struts being utilized both as struts and turning vanes for directing gas through a turn in the order of 90°.

Referring to FIG. 3A, outlet duct 70 is shown having turning struts 72. Turning struts 72 conventionally serve a two fold purpose. First, they structurally reinforce exhaust duct 70. Second, and because of their streamlined and turning configuration, turning struts 72 smooth the turn of main flow gases G. To this conventional configuration, I add my design.

Figure 3B:
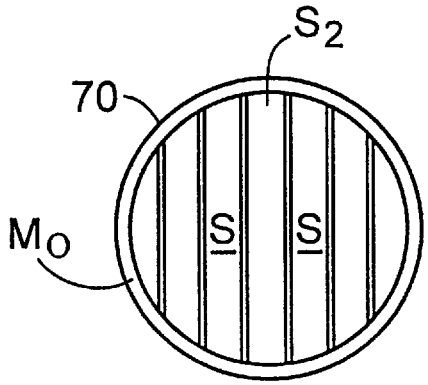
FIG. 3B is a section taken along lines 3B—3B of FIG. 3A illustrating placement of stall gas collection manifolds, routing of stall gas to cross duct struts, and placement of the struts to assist gas turning.

Referring to FIGS. 3A and 3B, stall gas is collected from outside boundary gases $G_O$ at stall gas collection manifold $M_O$, Here again I show both upstream collection port 74 and downstream collection port 76. In this case I prefer upstream collection port 74 as experience has shown that after the turn sufficient mixing in the flow enables outside boundary gases $G_O$ to be swept away from the vicinity of downstream collection port 76, and the pressure drop across the vanes helps insure a strong flow of stall gas toward outlet apertures 24.

Referring to FIG. 3B it will be seen that stall gas collection manifold $M_O$ surrounds exhaust duct 70 at the 90° turn in the duct. Turning struts 72 both serve to turn main flow gases G and to discharge through manifold outlet apertures 24 the collected stall gas.

Figure 4:
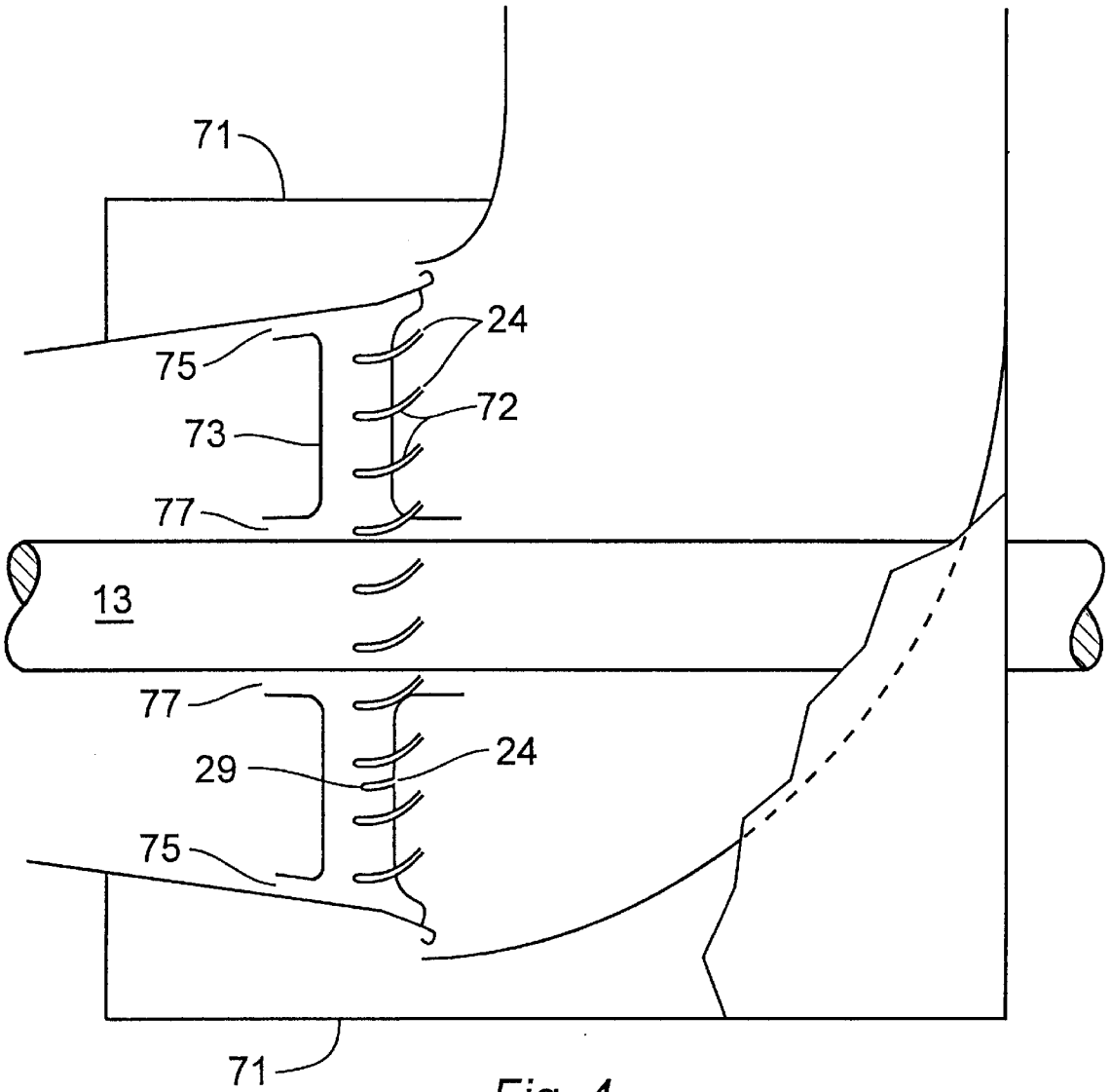
FIG. 4 illustrates a turning system similar to FIGS. 3A and 3B here illustrating the insertion of turning vanes in reinforcing relation through a collection box connected to a turbo machine exhaust.

Referring to FIG. 4, apparatus similar to collection box 71 shown in my Norris et al. U.S. Pat. No. 5,340,276 is set forth. To this embodiment, I have added turning struts 72 and cross bracing strut 73. These struts have respective outside upstream collection openings 75 and inside upstream collection openings 77. By the expedient of manifolding the struts with manifold apertures 24, a very effective redistribution of stall gas results. For additional pressure gradient to better pull stall gas, strutlet 29 may be added, strutlet 29 has outlets 24 in the low pressure zone adjacent to the side of a turning vane, or the widest part of a straight vane. With strutlet 29, it is preferred not to have outlets 24 on vanes 72.

It should be noted that collection box 71 can be used as a manifold to distribute gas. Alternately, the manifold can be separately constructed around diffuser D.

Figure 5A:
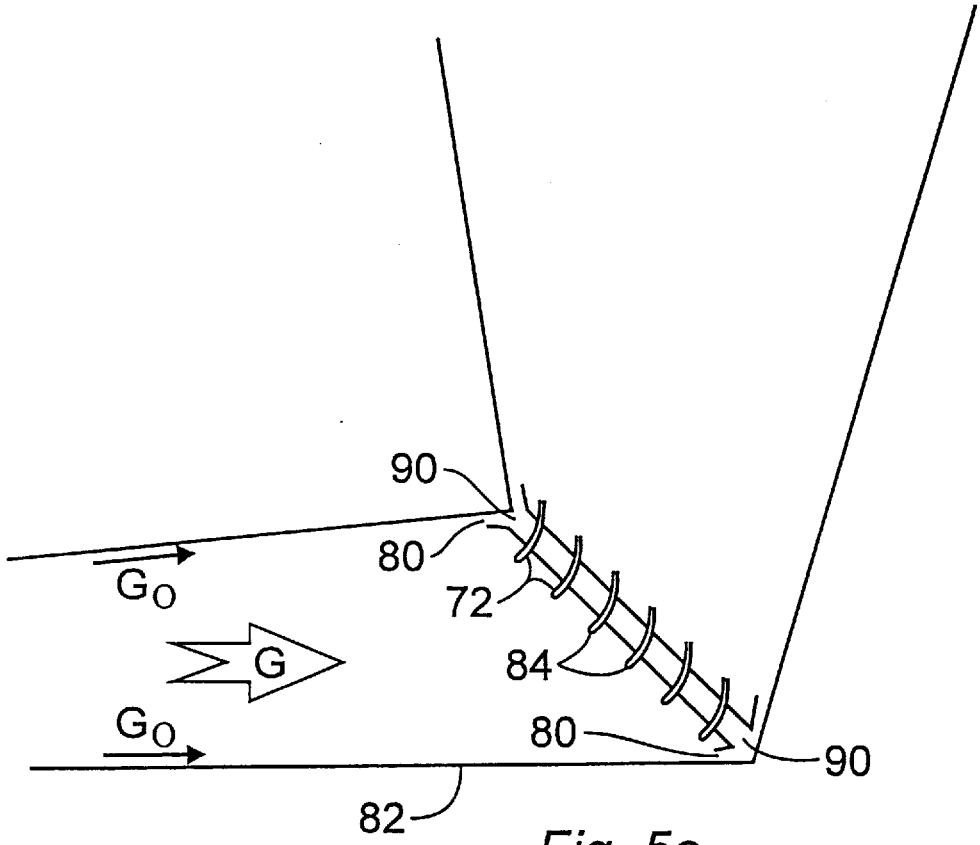
FIGS. 5A and 5B illustrates use of the turning vane type struts of this invention in rectangular ducting.
Figure 5B:
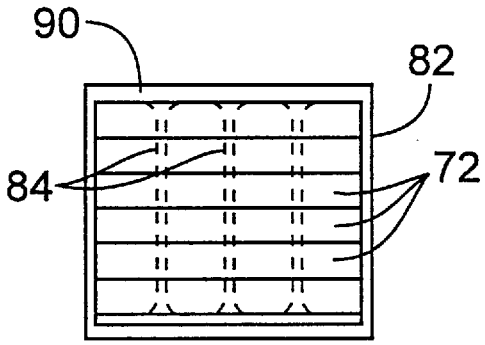

Referring to FIGS. 5A and 5B, the use of this invention with rectangular ducting 82 is disclosed. Peripheral collection manifold 90 is located at the joint of square ducting 82. Turning struts 72 are combined with linear struts 84. As before stall gas is collected from outside boundary gases $G_O$ at rectangular collector 80 and routed through turning struts 72 and linear struts 84 for redistribution.

Figure 6B:
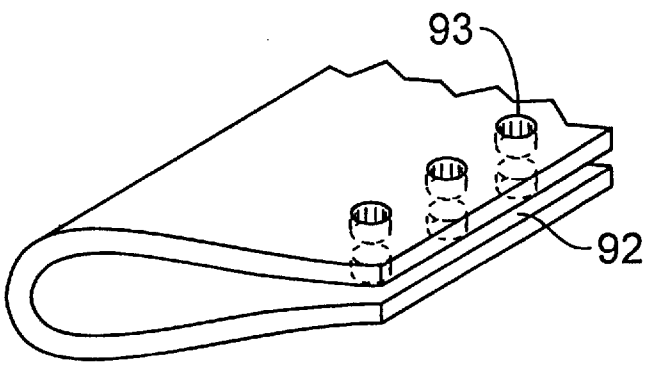
Figure 6D:
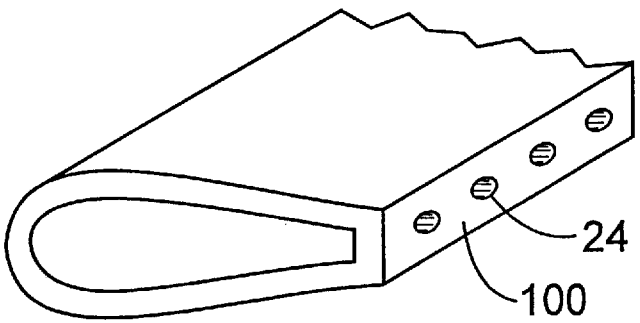
Figure 6A:
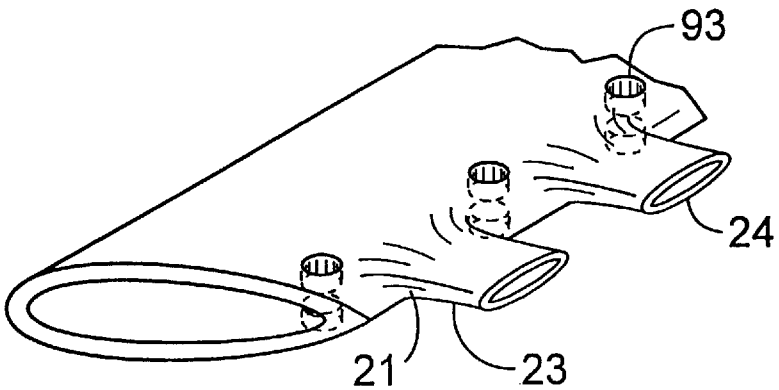

Finally, and with respect to the shape of struts S, attention is directed to FIGS. 6A–6D. Referring to FIG. 6A, struts S is shown with a conventional streamlined teardrop profile having outlet nozzles 23 and outlet apertures 24 for the discharge of collected gas. The actual outlet apertures extend downstream from the strut trailing edge. The trailing edge between the struts is thin. This is the normal and preferred embodiment of both the conventional struts.

Referring to FIG. 6A, the outlet apertures 24 can be positioned downstream of the strut trailing edge to assist the stall gas from the manifold. Static pressure can be less at ½ to one strut chord downstream, compared to right at the trailing edge. To further aid stall gas flow, outlet aperture 24 has a smaller area than the outlet nozzle entrance 23.

The area of outlet apertures 24 must be determined by experiment. As a starting point, the totalled area of the outlet nozzles on a strut should not exceed 25% of the main flow passage area or the totaled strut interior flow area, whichever is less, for a typical annular diffuser with a divergent half angle of 8°. Larger apertures will introduce flow inefficiencies.

With reference to FIG. 6B, conventional strut S is shown with continuous slit 92 and fasteners 93. While this embodiment is simple to make and can be used, it has been found that continuous slit 92 can cause propagation of stall gas along the strut. Consequently, continuous slit 92 is not preferred.

Figure 6C:
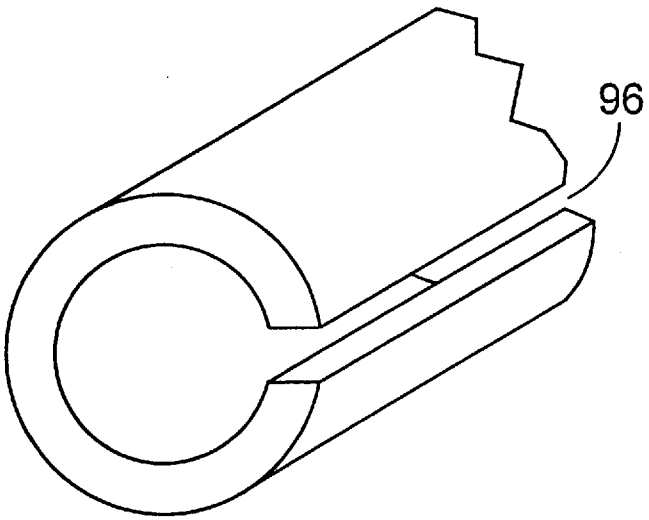

Referring to FIG. 6C, circular strut 94 is shown with continuous slit 96. This type of strut has utility where gases leaving the turbo machine have variable swirl or extreme turbulence. In these conditions, were a flattened shape strut similar to that shown in FIG. 6A to be used, the directionality of the strut would constitute an interference with the gas flow.

Finally, and referring to FIG. 6D, truncated strut 98 is shown with plate 100 closing the strut. As before, manifold apertures 24 are placed within plate 100 to effect gas discharge.

It should be understood, that dependent upon the design of the diffuser or duct, it may be desirable to cascade the apparatus of this invention. Accordingly, and referring to FIG. 7, I show D in schematic format with respective strut sets $S_1$, $S_2$, and $S_3$. The diffuser at each strut set preferably has a flow area 1½ to 2 times that of the duct at the preceding strut set, and the total angle of divergence may be 10° at most resulting in a short duct of large area increase.

Looking at FIG. 7, minimum inlet opening 36 area should be found by experiment. Larger areas increase flow inefficiencies. As a starting point, for an annular duct, the inlet slot width is 2% of the width of the flow passage. The width can be varied, being wider wherever more stall gas is found to be present.

The collection manifold 32 cross-section area should be found by experiment. As a starting point, this area should be twice that of the inlet opening 36 as summed over ¼ of the periphery. Space limitations will favor the smallest manifold possible.

This invention can be subject to modification. For example, both the collection of gases and redistribution of gases can be used with fairings or solid turning vanes placed within the gas flow. Open areas and gaps can be varied. Likewise, in any surface within a gas flow conduit where stall is likely to be encountered, struts such as those shown can be used for the redistribution of gas. For example, the principles of this invention can be used between blading of the turbo machine. The case of a conventional diffuser has been described, but it is understood that the methods apply to areas between blading as well, where the pressure increases in the direction of flow.

What is claimed is:

1. In an outlet from a turbo machine having a wall defining a diffuser conduit for routing gas, the improvement comprising:

the diffuser conduit defining an expanding flow path in the direction of gas flow;

a strut having a hollow interior, the strut fastened to the wall of the diffuser conduit, the strut extending from the wall of the diffuser conduit to a low static pressure, high velocity flow area within the diffuser conduit;

a collection duct having a substantially continuous inlet within the diffuser communicated to a high static pressure, low flow velocity area within the diffuser conduit adjacent the wall defining the diffuser conduit, the collection duct having an outlet into the hollow interior of the strut; and, means for discharging gas on the strut from the hollow interior of the strut to the low static pressure, high velocity flow area of the diffuser conduit.

2. In an outlet from a turbo machine having a wall defining a diffuser conduit for routing gas, according to claim 1 and further comprising:

the strut is teardrop shaped.

3. In an outlet from a turbo machine having a wall defining a diffuser conduit for routing gas, according to claim 1 and further comprising:

the strut is a structural member of the diffuser conduit forming the gas outlet.

4. In an outlet from a turbo machine having a wall defining a diffuser conduit for routing gas, according to claim 1 and further comprising:

the collection duct is located at the wall upstream of the strut.

5. In an outlet from a turbo machine having a wall defining a diffuser conduit for routing gas, according to claim 1 and further comprising:

the collection duct is located at the wall downstream of the strut.

6. In an outlet from a turbo machine having a wall defining a diffuser conduit for routing gas, according to claim 1 and further comprising:

the strut comprises a turning vane.

7. In an outlet from a turbo machine having a wall defining a diffuser conduit for routing gas, according to claim 1 and further comprising:

the gas outlet from the turbo machine includes an annular flow path having an outer generally cylindrical wall, an inner generally cylindrical wall, and an annular flow path defined between said outer and inner walls.

8. In an outlet from a turbo machine having a wall defining a diffuser conduit for routing gas, according to claim 7 and further comprising:

the collection duct is adjacent the inner generally cylindrical wall.

9. In an outlet from a turbo machine having a wall defining a diffuser conduit for routing gas, according to claim 7 and further comprising:

the collection duct is adjacent the outer generally cylindrical wall.

10. In an outlet from a turbo machine having a wall defining a diffuser conduit for routing gas, according to claim 1 and further comprising:

the strut includes a stall fence for preventing propagation of stall gas along the length of the strut.

* * * * *